US006677701B2

(12) United States Patent
Joo et al.

(10) Patent No.: US 6,677,701 B2
(45) Date of Patent: Jan. 13, 2004

(54) STEM FOR CATHODE RAY TUBE

(75) Inventors: Hwan-Sung Joo, Suwon (KR); Goichi Yasda, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 207 days.

(21) Appl. No.: 09/912,642

(22) Filed: Jul. 24, 2001

(65) Prior Publication Data

US 2002/0030432 A1 Mar. 14, 2002

(30) Foreign Application Priority Data

Jul. 27, 2000 (KR) ..... 2000-43279

(51) Int. Cl.[7] ..... H01J 31/00

(52) U.S. Cl. ..... 313/477 R; 313/477 HC; 313/482

(58) Field of Search ..... 313/477 R, 477 HC, 313/482

(56) References Cited

U.S. PATENT DOCUMENTS 4,101,803 A * 7/1978 Retsky et al. ..... 313/477 R
4,379,978 A * 4/1983 Hockenbrock ..... 313/477 R
6,054,805 A * 4/2000 Park et al. ..... 313/477 R
6,509,682 B2 * 1/2003 Ishinagawa et al. .. 313/477 HC

* cited by examiner

*Primary Examiner*—Nimeshkumar D. Patel
*Assistant Examiner*—Sharlene Leurig
(74) *Attorney, Agent, or Firm*—Christie, Parker & Hale, LLP

(57) ABSTRACT

A stem for a cathode ray tube. The stem includes a circular disc type stem part adapated to be integrally sealed with an end of a neck portion of the cathod ray tube, an exhausting tube mounted in the middle of the stem part for the exhausting of the cathode ray tube, a plurality of leads mounted to the stem part along a periphery of the exhausting tube and connected to respective electrodes of an electron gun for providing voltage signals, and a plurality of stem mounds mounted to the respective leads for fixing and supporting the leads in the stem parts and having different shapes and/or sizes depending on loads to be applied to inner leads, so that cracks of the stem mounds and blocking problems of a shadow mask due to the cracks may be prevented.

12 Claims, 6 Drawing Sheets

STEM FOR CATHODE RAY TUBE

CROSS REFERENCE TO RELATED APPLICATION

This application claims priority of application No. 2000-43279 filed in the Korean Industrial Property Office on Jul. 27, 2000, the content of which is incorporated hereinto by reference.

BACKGROUND OF THE INVENTION (a) Field of the Invention

The present invention relates to a stem for a cathode ray tube, in which shapes of stem mounds are differentiated according to loads applied to inner leads so that cracks of the stem mounds and apertures blocking of a shadow mask due to the crack particles may be prevented.

(b) Description of the Related Art

In general, a cathode ray tube is a display for realizing a certain image by a phosphor screen with electron beams which are emitted from an electron gun, wherein a stem is mounted with a plurality of leads for fixing the electron gun in a bulb and connecting the electrodes of the electron gun to an external set circuit, so as to apply a predetermined voltage signal to the respective electrodes of the electron gun.

As shown in FIG. 1, a related art cathode ray tube includes a face panel 1, a funnel 3 and a neck portion 5 which are integrally sealed and constitute a bulb 7, wherein the face panel 1 is formed with a phosphor screen 9 on an inner surface and is mounted with a shadow mask 11 at a predetermined distance from the phosphor screen 9, the funnel 3 has a deflection yoke 13 mounted on an outer peripheral surface, and the neck portion 5 has an electron gun 15.

In the structure as above, as the electron gun 15 emits three electron beams to their corresponding red R, green G and blue B phosphor layers, the electron beams are deflected by magnetic fields which are generated by the deflection yoke 13 and form a raster on the phosphor screen 9. The raster is divided into the corresponding R, G and B phosphor layers in the phosphor screen 9 by the shadow mask 11 serving as an color-selecting electrode, so that precise colors are displayed.

The electron gun 15 includes a cathode for emitting electrons, and a plurality of electrodes for forming an electronic lens by a potential difference and controlling focusing and acceleration degree of the electrons, wherein the cathode and the plurality of electrodes are connected to respective leads 19 which are attached to a stem 17 to be supplied with voltage signals from an external set circuit.

FIG. 2 is a front view of a related art stem and FIG. 3 is a plane view of the stem.

Referring to FIG. 2 and FIG. 3, the stem 17 includes a stem part 21 in the shape of a circular disc to be integrally melted with an end of the neck portion 5, an exhausting tube 23 mounted in the middle of the stem part 21 for connecting an inside of the bulb 7 to an unshown exhausting system, a plurality of leads 25 mounted along a periphery of the exhausting tube 23 and connected to the respective electrodes of the electron gun 15, and a plurality of stem mounds 27 for fixing and supporting the respective leads 25 to the stem part 21.

The leads 25 are divided into two parts, of which inner leads 25*a* are positioned inside the neck portion 5 with relation to the stem mounds 27 to be connected to the electron gun 15 and outer leads 25*b* are positioned outside the stem mounds 27 to be connected to the external set circuit.

According to the above structure, the inner leads 25*a* of the stem 17 are welded to the respective electrodes of the electron gun 15 directly or via an additional connection conductor, so that the stem 17 is integrated with the electron gun 15. The neck portion 5 and the stem part 21 are heated and melted together by a well-known torch heating method under the state that the stem 21 is facing to an end of the neck portion 5 to facilitate insertion of the electron gun 15 into the neck portion 5.

After fixing the stem 17 to the neck portion 5, the exhausting system is driven to evacuate an inside of the bulb 7 by means of the exhausting tube 23, and the inside of the bulb 7 is sealed in a high vacuum state after melting the exhausting tube 23 by the torch heating method, and cutting it.

As described above, the stem 17 is integrally joined to the neck portion 5 for serving to support the electron gun 15 in the bulb 7, wherein the plurality of leads 25 and the stem mounds 27 which fix and support the leads 25 are formed to have a same diameter and shape, so that the plurality of inner leads 25*a* and the stem mounds 27 have the same load intensity characteristics.

The inner leads 25*a* are, however, applied with a bending deformation stress due to the load and welding of the electron gun 15, since the whole melting and discharging procedure of the stem 17 and the neck portion 5 is carried out under the circumstances that the electron gun 15 is fixed in the stem 17, and particularly, the load is not uniformly applied to all the inner leads 25*a* but is concentrated on some of the inner leads 25*a* which support the electron gun 15.

Therefore, cracks are apt to be generated at the load-concentrated leads 25*a* due to the high load, so that the supporting force of the leads 25 becomes decreased due to the cracks, and beam passing apertures of the shadow mask 11 are blocked by glass powder which is generated in the stem mounds 27 and advances into the bulb 7.

Such an apertures blocking of the shadow mask 11 disturbs passage of the electron beams and accordingly the phosphor screen 9 can not emit light, resulting in the formation of a black spot at a certain position.

SUMMARY OF THE INVENTION

It is an object of the present invention to provide a stem for a cathode ray tube in which stem mounds are reinforced to prevent cracks from being generated therein to accordingly prevent blockage of apertures of a shadow mask caused by glass powder from the cracks.

In order to achieve this object, the stem for a cathode ray tube includes a stem part of a circular disc type to be integrally sealed with an end of a neck portion, an exhausting tube mounted in the middle of the stem part for the exhausting of a bulb, a plurality of leads mounted to the stem part along a periphery of the exhausting tube and connected to respective electrodes of an electron gun for providing voltage signals, and a plurality of stem mounds mounted to the respective leads for fixing and supporting the leads on the stem parts and having different shapes depending on loads to be applied to the leads, wherein some of the stem mounds have an increased diameter as the loads applied to their corresponding leads increase.

In the stem for a cathode ray tube of the present invention, cracks of the stem mounds and the apertures blocking of the shadow mask due to the crack particles are effectively prevented.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings wherein.

DETAILED DESCRIPTION OF THE PREFERRED EMBODIMENTS

A preferred embodiment of this invention will be explained with reference to the accompanying drawings.

Figure 1:
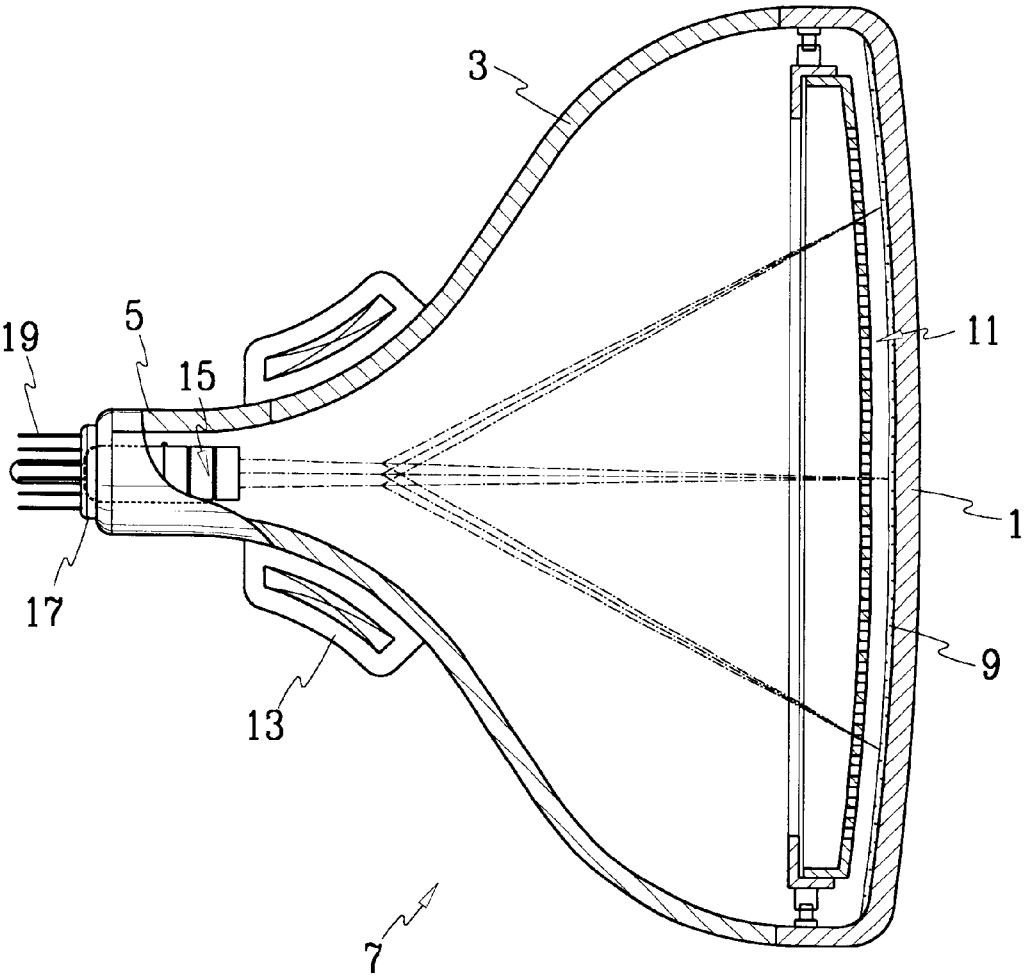
FIG.1(Prior Art)
FIG. 1 is a sectional view of a cathode ray tube having a prior art stem.
Figure 2:
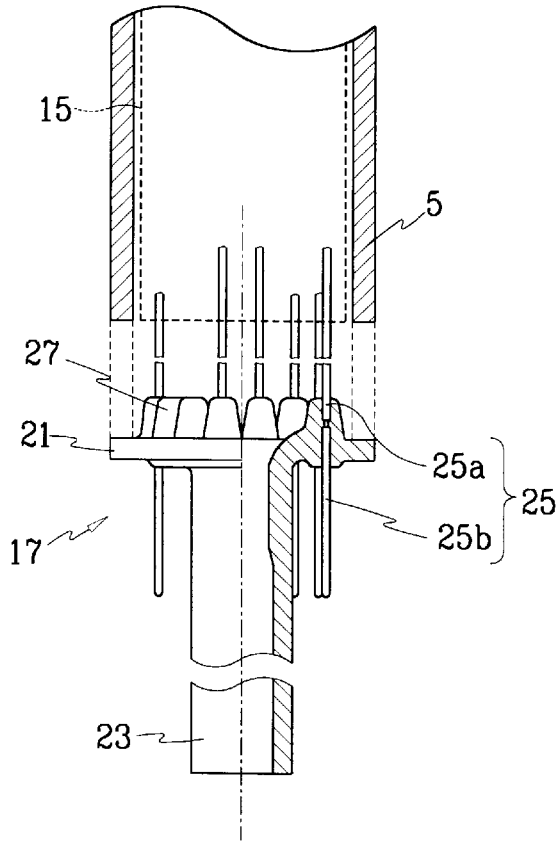
FIG.2(Prior Art)
FIG. 2 is a front view of the prior art stem.
Figure 3:
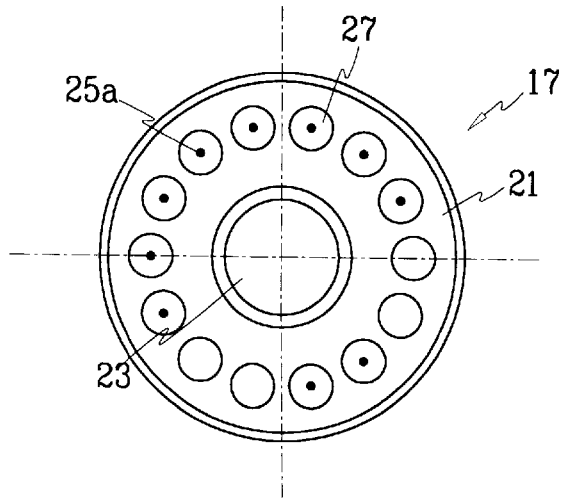
FIG.3(Prior Art)
FIG. 3 is a plane view of the prior art stem.
Figure 4:
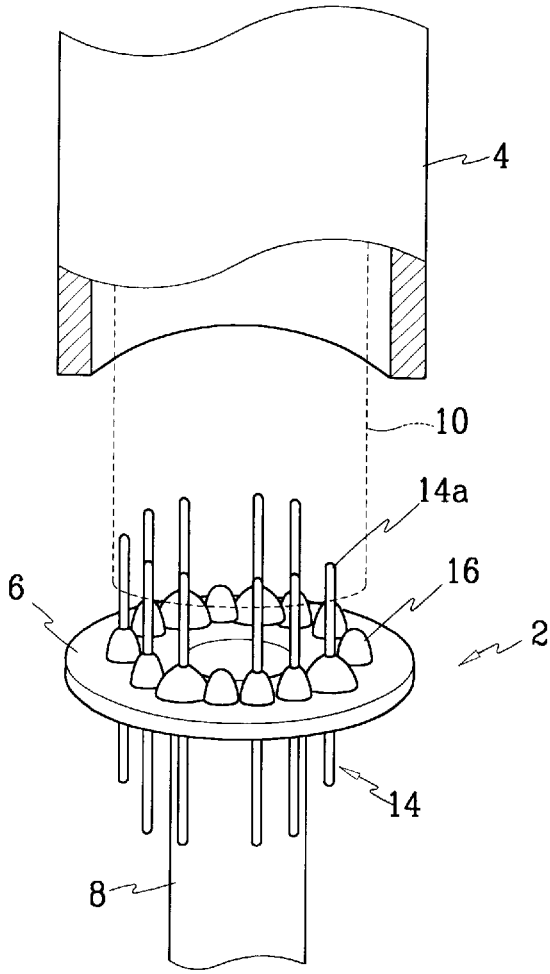
FIG. 4 is a perspective view of a stem according to a first preferred embodiment of the present invention.
Figure 5:
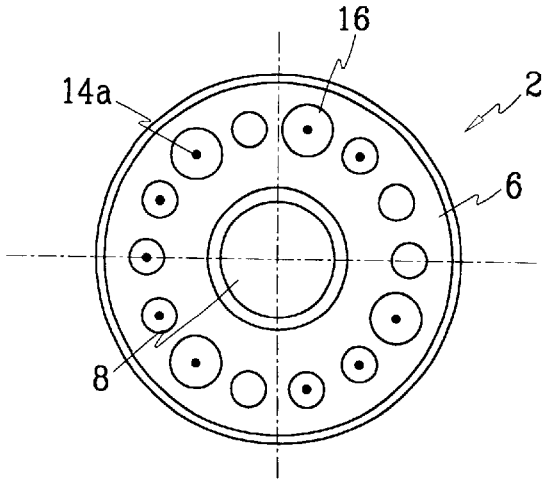
FIG. 5 is a plane view of a stem of FIG. 4.
Figure 6:
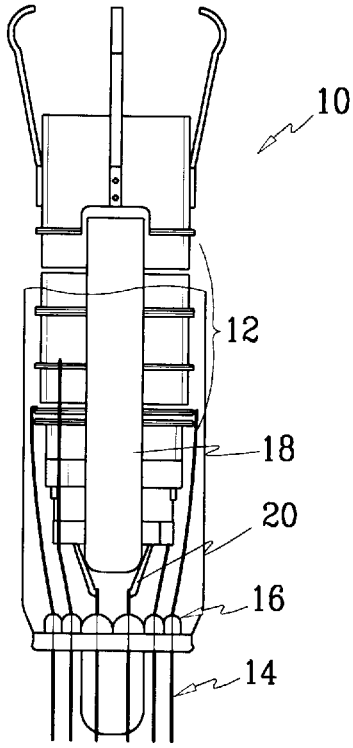
FIG. 6 is a front view of an electron gun, which is fixed on the stem of FIG. 4.

FIG. 4 is a front view of a stem according to a first embodiment of the present invention, FIG. 5 is a plane view of the stem, and FIG. 6 is a front view of an electron gun that is integrated with the stem and a neck portion.

As shown in FIG. 4 to FIG. 6, a stem 2 includes a stem part 6 of a circular disc type which is integrally joined with a neck portion 4, an exhausting tube 8 mounted in the middle of the stem part 6 for the exhausting of a bulb, a plurality of leads 14 mounted around a periphery of the exhausting tube 8 and connected to respective electrodes 12 of an electron gun 10, and a plurality of stem mounds 16 for fixing and supporting the respective leads 14 in the stem part 6, of which shapes are differentiated according to loads to be applied to the leads 14.

The stem mounds 16 are integrally formed with the stem part 6 in the shape of a mound toward the electron gun 10, each of the stem mounds 16 having a predetermined height and a predetermined diameter. The stem mounds 16 are respectively penetrated by the leads 14, serving to firmly fix and simultaneously support the penetrating leads 14 in the stem part 6.

The leads 14 supported by the stem mounds 16 are respectively connected to the electrodes 12 of the electron gun 10 for transmitting a voltage signal from an external set circuit and simultaneously applying the load of the electron gun 10 to the stem 2, wherein the load of the electron gun 10 is not uniformly applied to all of the plurality of leads 14 but is concentrated upon some of the leads 14.

The respective electrodes 12 of the electron gun 10 are fixed on a bead glass 18 so that the load of the electron gun 10 is mainly applied to the stem 2 via supporting members 20 which fix the bead glass 18 and leads 14 that are fixed to the supporting members 20. Therefore, the load is concentratedly applied to the leads 14 which are connected to the supporting members 20, so that it is necessary to further reinforce the stem mounds 16 which support the leads 14 connected to the supporting members 20 in order to prevent inclination of the supporting members 20 due to external impact.

In the stem 2 of the present invention, the load intensity characteristics are improved by differentiating the shape of the stem mounds 16 in consideration of the load characteristics applied to the respective inner leads 14*a*. For such a reinforcement of the stem, certain stem mounds 16 have an increased diameter as the load applied to their corresponding inner leads 14*a* increases, as shown in FIG. 5.

Figure 7:
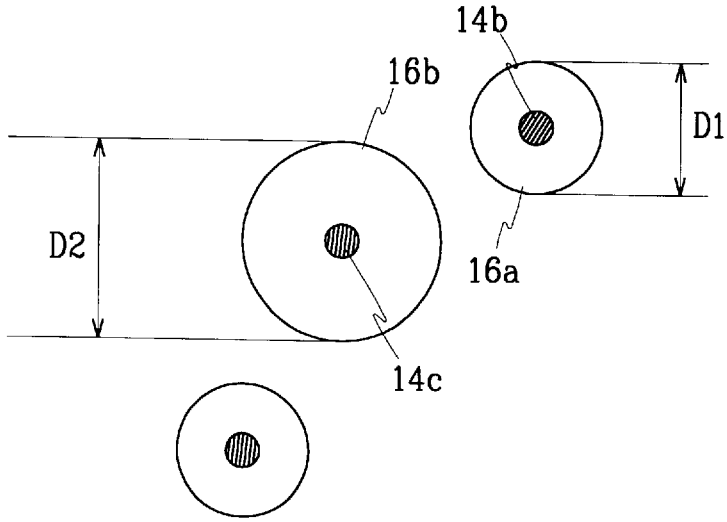
FIG. 7 is an expanded view of FIG. 5.

As an example, as shown in FIG. 7, first stem mounds 16*a*, which support first leads 14*b* to which a general slight load is applied or are not penetrated by any lead, have a diameter D1 of 1.8 mm, and second stem mounds 16*b*, which support second leads 14*c* to which a concentrated load is applied, have a diameter D2 of about 3.2 mm, which is almost twice the diameter of the first stem mounds 16*a* in the vicinity of the second stem mounds 16*b*.

If the second stem mounds 16*b* are enlarged as above, the cross-sections of the respective second stem mounds 16*b* are enlarged, improving the load intensity characteristics, so the second leads 14*c* to which the concentrated load is applied may be effectively supported, preventing cracks of the stem mounds 16.

In order to properly dispose a plurality of such second stem mounds 16*b*, of which shape and size are differentiated according to the applied load, the first stem mounds 16*a* which support the first leads 14*b* to which the general slight load is applied may be formed with a reduced diameter in the range such that cracks are not generated.

Figure 8:
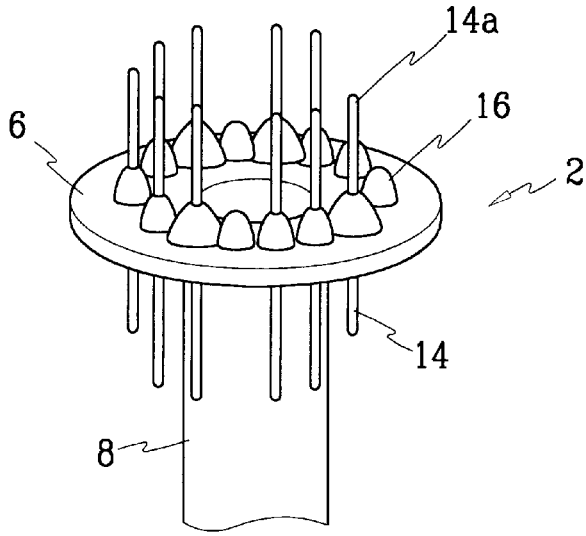
FIG. 8 is a perspective view of a stem according to a second preferred embodiment of the present invention.

FIG. 8 shows a stem 2 according to a second embodiment of the present invention, of which stem mounds 16 are increased in diameter and height simultaneously in proportion to the load applied to their corresponding inner leads 14*a* in order to improve the supporting force of the second leads 14*c* shown in FIG. 7.

Figure 9:
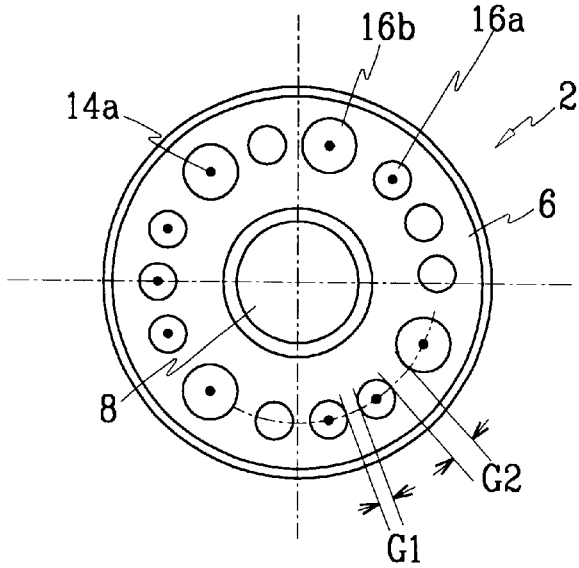
FIG. 9 is a plane view of a stem according to a third preferred embodiment of the present invention.

FIG. 9 shows a stem 2 according to a third embodiment of the present invention, in which not only the diameter of the stem mounds 16 but also an interval between such stem mounds 16 are simultaneously changed in proportion to the load applied to the inner leads 14*a*.

A plurality of the first stem mounds 16*a* to which the general slight load is applied are densely disposed on the stem 2 by an interval of G1, while a plurality of the second stem mounds 16*b* to which the concentrated load is applied are disposed sparsely by an interval of G2 with an increased diameter.

As described hereinabove, according to this embodiment of the present invention, some of the stem mounds 16 are reinforced by differentiating their shapes and increasing their diameter with respect to the other stem mounds 16 in proportion to the load applied to the inner leads 14*a*, preventing the cracks in the stem mounds 16.

Figure 10:
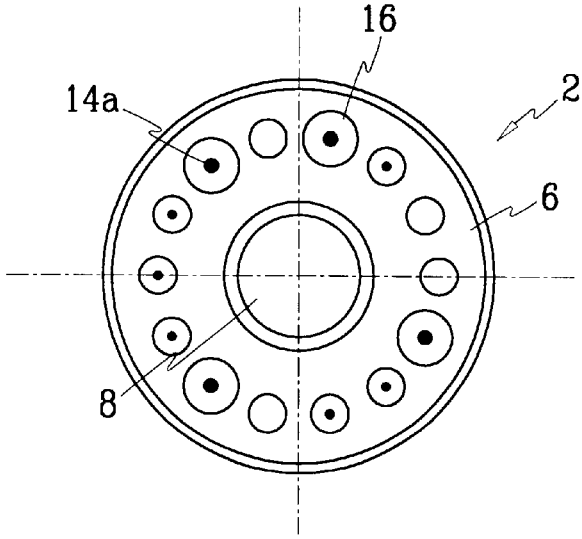
FIG. 10 is a plane view of a stem according to a fourth embodiment of the present invention.
Figure 11:
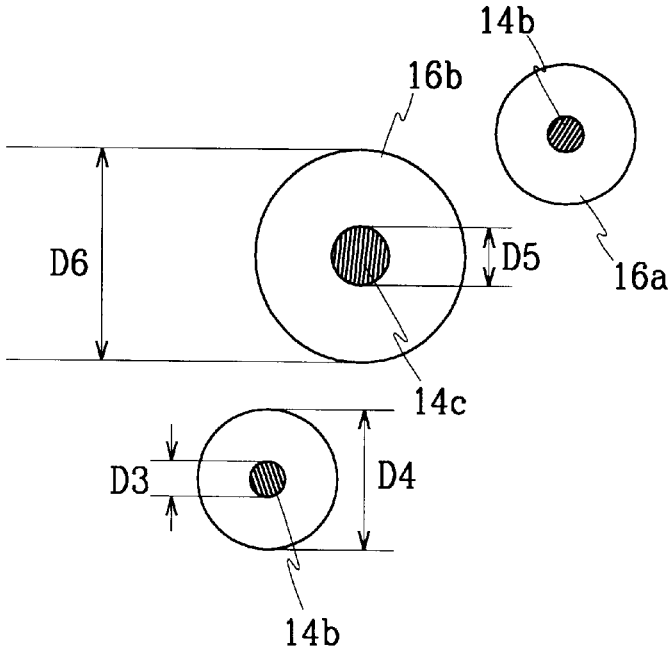
FIG. 11 is a partially expanded view of FIG. 10.

FIG. 10 is a plane view of a stem of a fourth embodiment of the present invention, and FIG. 11 is a partial expanded view of FIG. 10.

Referring to FIG. 10 and FIG. 11, diameters of the respective inner leads 14*a* and the diameters of stem mounds 16 supporting the inner leads 14*a* are simultaneously changed in proportion to the load applied to the respective inner leads 14*a*.

In other words, the first leads 14*b* to which the general slight load is applied and the first stem mounds 16*a* supporting these leads 14*a* have reduced diameters respectively in the range such that cracks are not generated, while second leads 14*c* to which the concentrated load is applied and the second stem mounds 16*b* supporting these leads have an increased diameter respectively, thereby reinforcing the load intensity characteristics.

For example, diameter D3 of the first leads 14*b* to which the general slight load is applied is set to be 0.6 mm, and diameter D4 of the first stem mounds 16*a* for supporting these leads is set to be 1.8 mm. On the other hand, diameter D5 of the second leads 14*c* to which the concentrated load is applied is set to be 1.0 mm, and diameter D6 of the second stem mounds 16*b* for supporting these leads is set to be 3.2 mm.

As above, the diameters of the inner leads 14*a* are differentiated according to the load applied to them, thereby improving the load intensity characteristics thereof. Simultaneously, the diameters of the stem mounds 16 supporting the leads 14 are differentiated for more firmly supporting the second leads 14*c* applied with the concentrated load, thereby effectively preventing the cracks in the stem mounds 16.

Therefore, in this embodiment, the generation of cracks due to the concentrated load applied to the inner leads 14*a* may be prevented by reinforcing the stem mounds 16, and the blocking problem whereby the glass powder generated by cracks of the stem mounds 16 blocks the beam passing apertures of the shadow mask may be effectively reduced, thereby improving the manufacturing yield of the cathode ray tubes.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A stem for a cathode ray tube including a bulb having a neck portion and in which an electron gun is to be inserted, the stem comprising:

a stem part comprising a circular disc to be integrally sealed with an end of the neck portion;

an exhausting tube mounted in the middle of the stem part for the exhausting of the bulb;

a plurality of leads mounted to the stem part along a periphery of the exhausting tube and to be connected to respective electrodes of the electron gun for providing voltage signals; and a plurality of stem mounds each having mounted therein a respective lead of the plurality of leads for fixing and supporting the leads in the stem part, wherein at least two of the plurality of the stem mounds have different shapes from each other depending on a load to be applied to their respective leads.

2. The stem for a cathode ray tube of claim 1, wherein the at least two stem mounds have diameters which are increased relative to diameters of others of said plurality of stem mounds according to an increased load to be applied to their corresponding leads.

3. The stem for a cathode ray tube of claim 1, wherein the at least two stem mounds have heights which are increased relative to heights of others of said plurality of stem mounds according to an increased load to be applied to their corresponding leads.

4. The stem for a cathode ray tube of claim 2, wherein the at least two stem mounds have heights which are increased according to an increased load to be applied to their corresponding leads.

5. The stem for a cathode ray tube of claim 1, wherein the at least two stem mounds are disposed at spaced intervals which are increased relative to the spacing of others of said plurality of stem mounds according to an increased load to be applied to their corresponding leads.

6. The stem for a cathode ray tube of claim 1, wherein the respective leads of the at least two stem mounds have diameters which are increased relative to the diameters of the leads mounted in others of said plurality of stem mounds according to an increased load to be applied to such respective leads.

7. A stem for a cathode ray tube comprising:

a stem part connected with an end of a neck portion;

a plurality of leads mounted to the stem part and to be connected to respective electrodes of an electron gun for providing voltage signals; and a plurality of stem mounds each having mounted therein a corresponding lead of the plurality of leads for fixing and supporting the leads in the stem part, wherein at least two of the plurality of the stem mounds have different shapes from each other depending on a load to be applied to their respective leads.

8. The stem of claim 7, wherein the at least two stem mounds have diameters which are increased relative to diameters of others of said plurality of stem mounds according to an increased load to be applied to their corresponding leads.

9. The stem of claim 7, wherein the at least two stem mounds have heights which are increased relative to heights of others of said plurality of stem mounds according to an increased load to be applied to their corresponding leads.

10. The stem of claim 8, wherein the at least two stem mounds have heights which are increased according to an increased load to be applied to their corresponding leads.

11. The stem of claim 7, wherein the at least two stem mounds are disposed at intervals which are increased relative to spacing of others of said plurality of stem mounds according to an increased load to be applied to their corresponding leads.

12. The stem of claim 7, wherein the respective leads of the at least two stem mounds have diameters which are increased relative to diameters of the leads mounted in others of said plurality of stem mounds according to an increased load to be applied to them.

* * * * *